US007096518B2

(12) United States Patent
Takenaga

(10) Patent No.: US 7,096,518 B2
(45) Date of Patent: Aug. 29, 2006

(54) BODY PART CLEANSING UNIT FOR TOILET

(76) Inventor: Isao Takenaga, 67 Starr Ave., Turlock, CA (US) 95380

( * ) Notice: Subject to any disclaimer, the term of this patent is extended or adjusted under 35 U.S.C. 154(b) by 183 days.

(21) Appl. No.: 10/754,976

(22) Filed: Jan. 9, 2004

(65) Prior Publication Data

US 2005/0000006 A1 Jan. 6, 2005

(30) Foreign Application Priority Data

Jul. 4, 2003 (JP) ..... 2003-102671

(51) Int. Cl.
*A47K 3/20* (2006.01)

(52) U.S. Cl. ..... 4/420.4; 4/420.2; 4/443

(58) Field of Classification Search ..... 4/420.1–420.5, 4/443, 447, 448

See application file for complete search history.

(56) References Cited

U.S. PATENT DOCUMENTS 4,581,779 A * 4/1986 Matsui et al. ..... 4/420.2
4,761,836 A * 8/1988 Tsutsui et al. ..... 4/420.2
4,926,509 A * 5/1990 Bass ..... 4/448
4,980,933 A * 1/1991 Tsutsui et al. ..... 4/420.2

* cited by examiner

*Primary Examiner*—David J. Walczak
*Assistant Examiner*—Huyen Le
(74) *Attorney, Agent, or Firm*—Gerald E. Hespos; Anthony J. Casella

(57) ABSTRACT

A body washing unit for a toilet stool, comprising: a case body disposed on the upper surface of a toilet-stool main body, a toilet seat and a toilet-seat cover being connectable to the case body so as to hinge; and a warm-water nozzle incorporated into the case body, wherein cold water in a duct passage for the warm-water nozzle is discharged, before the warm-water nozzle is used.

10 Claims, 8 Drawing Sheets

BODY PART CLEANSING UNIT FOR TOILET

SUMMARY OF THE INVENTION

1. Field of the Invention

This invention relates to a body washing unit for a toilet stool which can be easily attached to a toilet stool that has already been installed.

2. Description of the Related Art

Toilet stools having the body-washing function of automatically washing an anal part with warm water after evacuation have been coming into wide use.

A conventional toilet stool having a body-washing function is configured by incorporating a heater tank for heating cold water from the outside to make the water warm, and a warm-water nozzle for emitting a jet of the warm water from the heater tank onto an anal part to wash the part. In the heater tank, which an electric heater is incorporated into, plenty of warm water required for one washing operation is constantly heated and stored. If you makes a switching operation after evacuation, that allows warm water to jet out of the warm-water nozzle, washing your anal part clean.

Another type of body washing unit is also available on the market, which is provided as an additional function of already-installed toilet stools. Such a body washing unit is configured by incorporating a heater tank and a warm-water nozzle into a unit main body with a toilet seat and a toilet-seat cover as well.

In the above described prior art, the heater tank constantly warms up a proper quantity of warm water to a suitable temperature and holds it in storage. This could cause a considerable amount of electricity to waste. In addition, if the heater tank is installed at a place where warm water or boiling water can be used, some of installation expenses could go to waste. Furthermore, if an additional function-type of body washing unit is used, a reusable toilet-seat or toilet-seat cover of a toilet stool that has already been installed has to be scrapped. This is because such a washing unit includes a toilet seat or a toilet-seat cover as its appendix.

In consideration of the aforementioned problems of the prior art, it is an object of the present invention to provide a body washing unit for a toilet stool where a warm-water nozzle is incorporated into a case body, which can be added to a toilet stool that has already been installed, with ease and within reason.

SUMMARY OF THE INVENTION

In order to attain the above described object, the body washing unit for a toilet stool according to the present invention, comprises: a case body disposed on the upper surface of a toilet-stool main body, a toilet seat and a toilet-seat cover being connectable to the case body so as to hinge; and a warm-water nozzle incorporated into the case body, in which cold water in a duct passage for the warm-water nozzle is discharged, before the warm-water nozzle is used.

Furthermore, the warm-water nozzle can be driven between a waiting position inside the case body and a usage position on the side of the front surface of the case body.

Furthermore, a mixing valve may also be incorporated into the case body, and the mixing valve mixes water from the outside and hot water and supplies warm water to the warm-water nozzle.

Furthermore, a heater unit can be attached to the outside of the case body, and the heater unit heats water from the outside and supplies the heated water to an inlet on the hot-water side of the mixing valve. Furthermore, a spacer frame supporting the toilet seat over the toilet-stool main body can be attached to the front surface of the case body.

According to the above described configuration of the body washing unit for a toilet stool according to the present invention, the warm-water nozzle incorporated into the case body discharges cold water in the duct passage before emitting a jet of warm water onto an anal part to wash the part. This can prevent the warm water initially jetted out of the warm-water nozzle from being too cold for the user to feel comfortable. Herein, it is preferable that the duct-passage cold water be discharged into the toilet-stool main body and drained away by opening a drain valve or turning the warm-water nozzle downward. Moreover, a toilet seat and a toilet-seat cover can be connected to the case body so as to hinge, so that a toilet-seat and a toilet-seat cover of a toilet stool that has already been installed can be kept used as they are, even though the body washing unit is added to such a toilet stool.

The warm-water nozzle moves forward to a usage position when emitting a jet of warm water, while it is kept back at a waiting position inside the case body when not in use. This can reduce occasions when evacuated stuff adheres to the warm-water nozzle to make it dirty, to a minimum. Herein, the warm-water nozzle may be driven either electrically or manually.

The mixing valve incorporated into the case body can mix water from the outside and hot water into warm water having a suitable temperature and supply it to the warm-water nozzle. This will make it possible to use hot water from the outside if the body washing unit is installed in a place where warm water or hot water can always be used. As a result, no heater tank would be needed, preventing a waste of electricity.

If a heater unit is provided as an appendix, necessary hot water can be secured using the heater unit. In this case, a jet of warm water with a suitable temperature can be emitted from the warm-water nozzle even in a place where warm water or hot water is impossible to use. Preferably, the heater unit should be an electric heater of what is called the instantaneous water heater-type. Such an electric heater heats up water flowing inside a heat-exchanger unit, preventing electricity from being constantly turned on. As the heater unit, an indirectly-heating system using currents of hot air may also be used, in which excess heat can be used for indoor heating, as the need arises.

The spacer frame attached to the front surface of the case body helps keep the vertical distance between a toilet-stool main body and a toilet seat at a certain distance, even though the toilet seat is attached to the upper surface of the case body when the body washing unit is added to an already-installed toilet stool. As a result, a toilet seat can be securely supported over a toilet-stool main body.

These and other objects, features and advantages of the invention will become more apparent upon reading the following detailed description along with the accompanying drawings.

DETAILED DESCRIPTION OF THE PREFERRED EMBODIMENTS

Hereinafter, a body washing unit for a toilet stool according to an embodiment of the present invention will be described with reference to the attached drawings.

Figure 1:
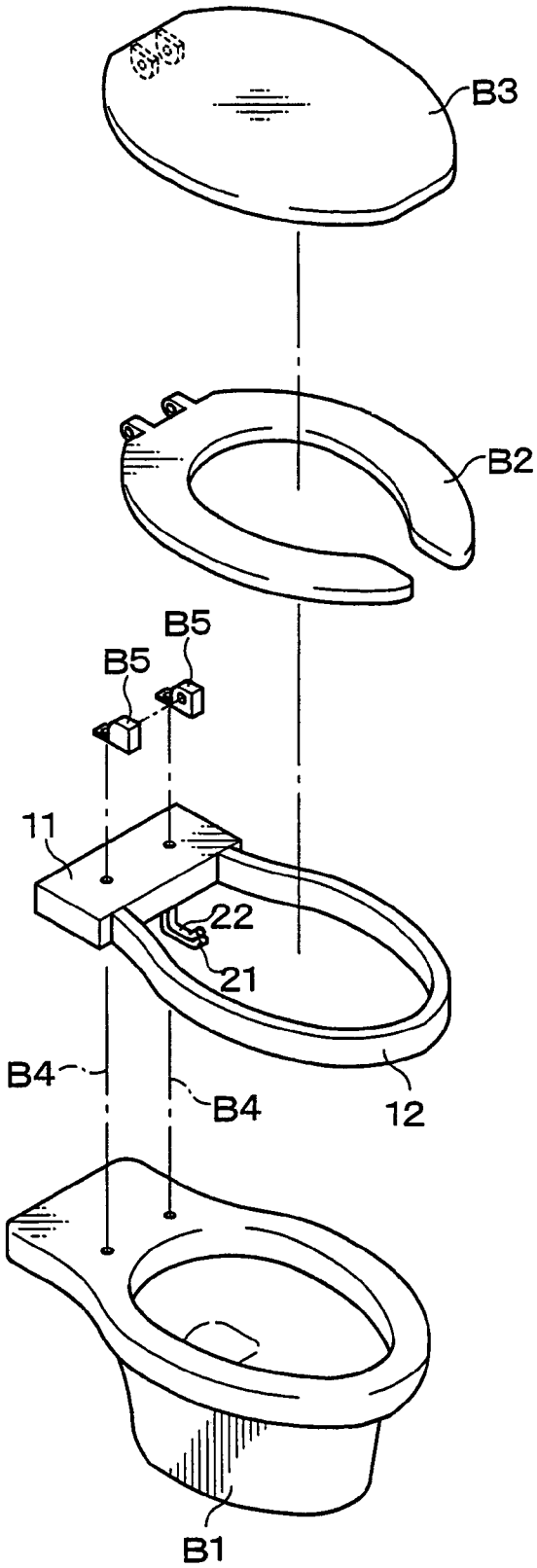
FIG. 1 is a perspective exploded view showing how to use a body washing unit for a toilet stool according to the present invention.

The body washing unit for a toilet stool comprises a case body 11 and a warm-water nozzle 21 incorporated into the case body 11 (see FIG. 1).

The case body 11 can be disposed on the upper-surface rear part of a toilet-stool main body B1 of an already-installed toilet stool by means of bolts B4, B4 for attaching a toilet seat B2 and a toilet-seat cover B3. Herein, the bolts B4, B4 are bolts for fixing hinge bodies B5, B5 by means of which the toilet-seat B2 and the toilet-seat cover B3 are attached to a toilet-stool main body B1. The toilet seat B2 and the toilet-seat cover B3 can be hinged and connected to the upper surface of the case body 11 on the toilet-stool main body B1, using the hinge bodies B5, B5. A spacer frame 12 supporting the toilet seat B2 on the toilet-stool main body B1 is attached to the front surface of the case body 11. Herein, the spacer frame 12 has a substantially same shape as the upper surface of the toilet-stool main body B1 so as to securely support the toilet seat B2 located on the case body 11 over the toilet-stool main body B1.

Figure 2:
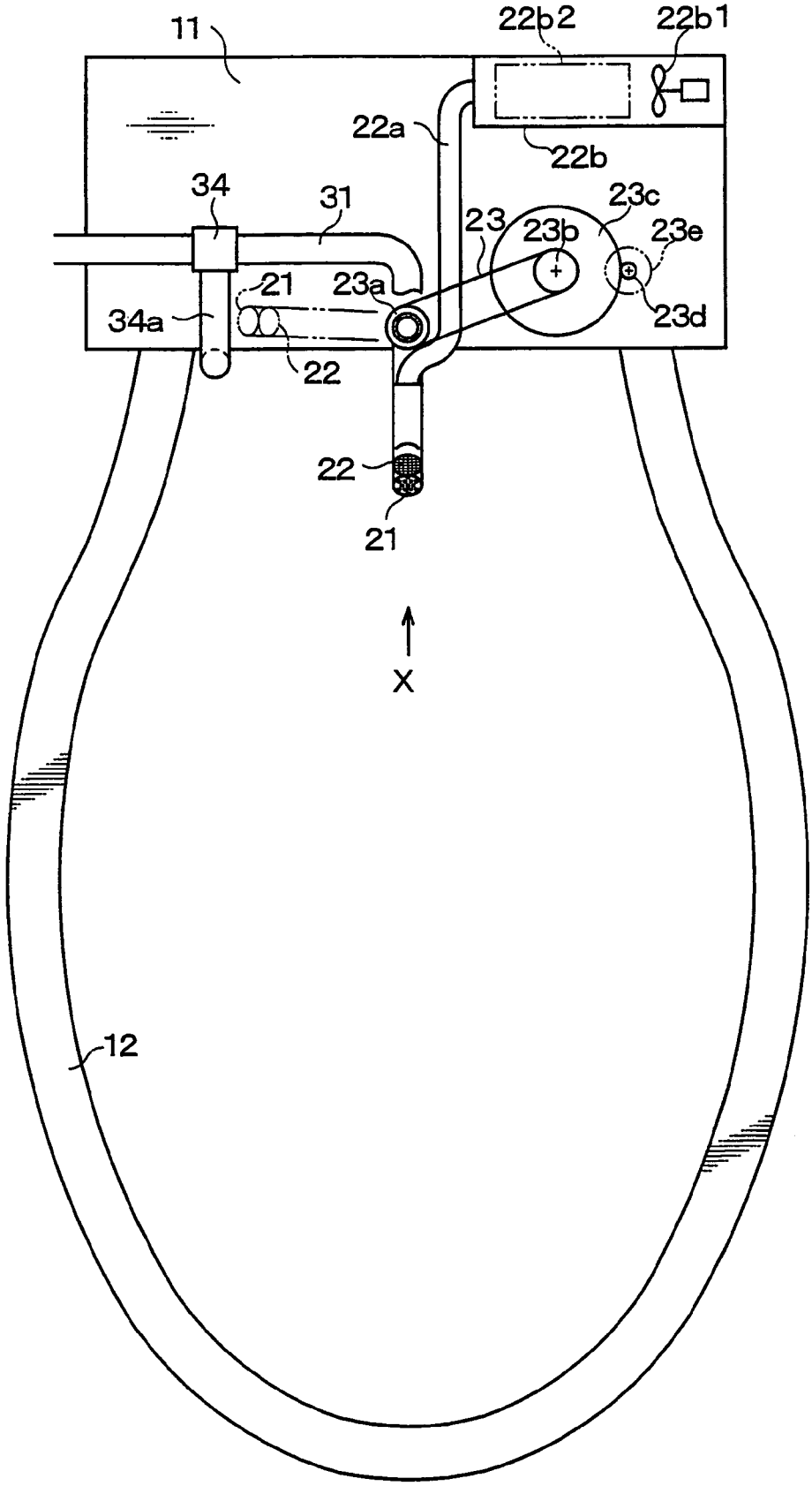
FIG. 2 is a top plan view showing the whole configuration of the body washing unit.
Figure 3:
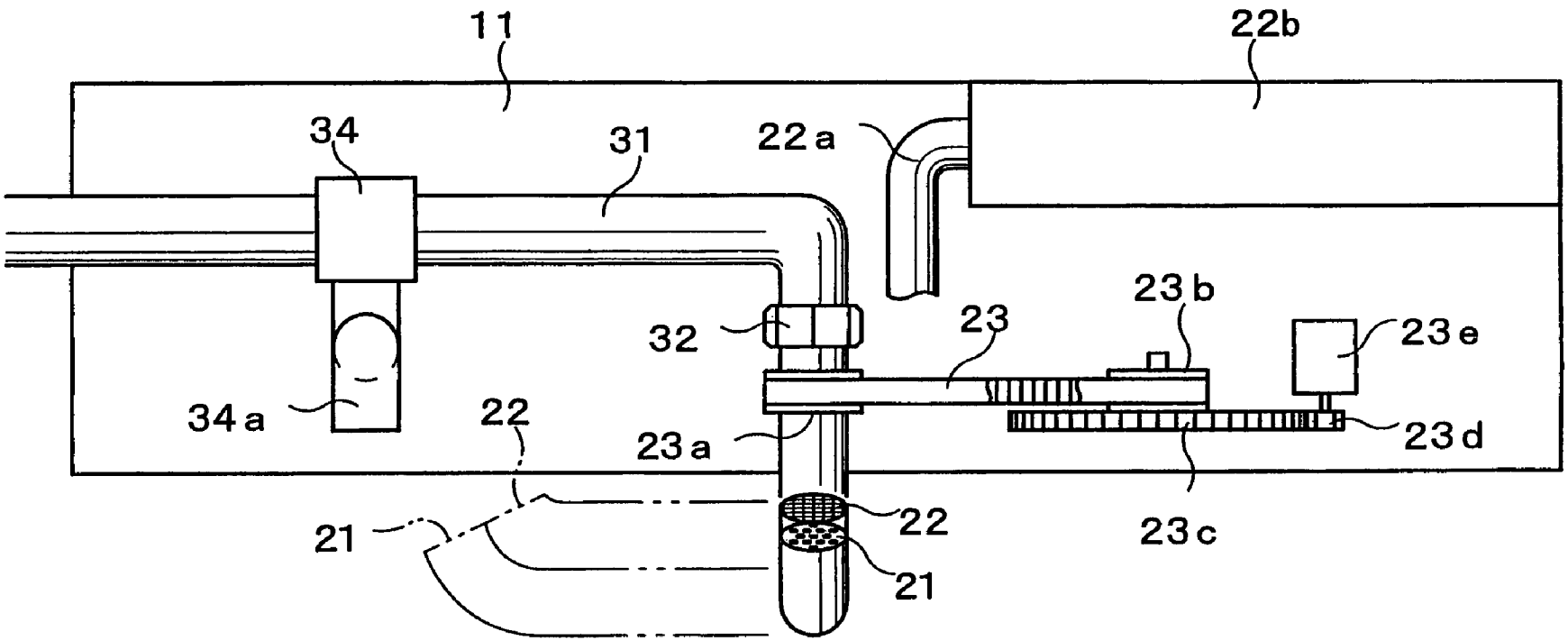
FIG. 3 is a plan view seen from the direction of an arrow X of FIG. 2.

The warm-water nozzle 21 is integrated with a warm-air nozzle 22 (see FIG. 2 and FIG. 3). On the side of the front surface of the case body 11, the warm-water nozzle 21 and the warm-air nozzle 22 extend downward, bend forward and obliquely bend up. Thereby, the warm-water nozzle 21 and the warm-air nozzle 22 emits a jet of warm water, and blows a blast of warm air, respectively, onto the anal part of a user sitting on the toilet seat B2.

The warm-water nozzle 21 is supported to a downward-bending part of a duct passage 31 for supplying warm water inside the case body 11, via a rotary joint 32, so that it can turn horizontally. A timing pulley 23*a* for a timing belt 23 is attached to a base part of the warm-water nozzle 21. The other timing pulley 23*b* for the timing belt 23 is connected to a motor 23*e* via gears 23*c*, 23*d*. The warm-water nozzle 21, together with the warm-air nozzle 22, can be electrically driven by the forward and reverse drive of the motor 23*e*. Specifically, they are driven between a usage position (see each solid line of FIG. 2 and FIG. 3, and FIG. 1) on the side of the front surface of the case body 11 and a waiting position (see each two-dotted chain line of FIG. 2 and FIG. 3) inside the case body 11.

The warm-air nozzle 22 is connected to a warm-air heater 22*b* inside the case body 11 via a flexible hose 22*a* having a sufficient length. The warm-air heater 22*b* is configured, for example, by disposing an electric heater 22*b*2 ahead of a motor-driven fan 22*b*1 (see FIG. 2), so that warm air can be blown out of the tip of the warm-air nozzle 22 through the flexible hose 22*a*.

Figure 4:
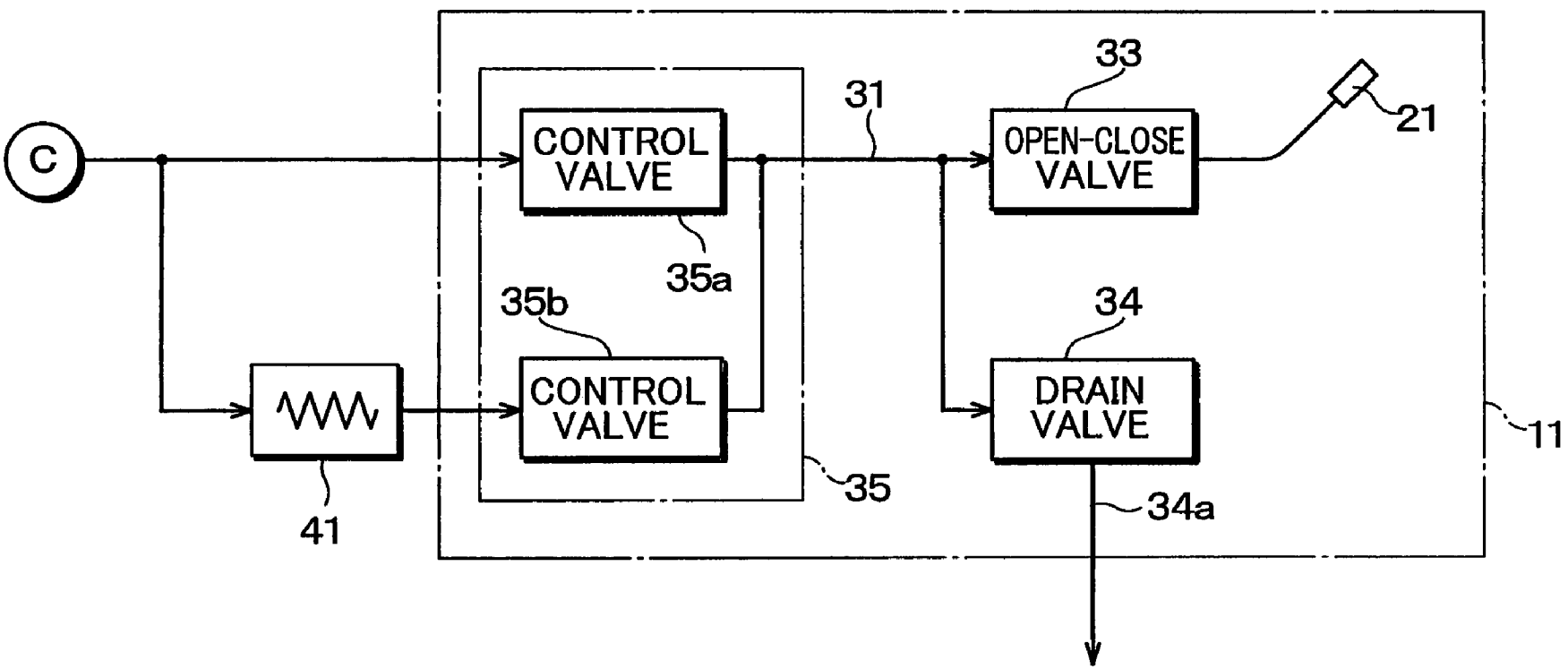
FIG. 4 is a water-flow diagram of the body washing unit.

An open-close valve 33, a drain valve 34 and a mixing valve 35, which are incorporated into the case body 11, are connected to the duct passage 31 for the warm-water nozzle 21 (see FIG. 4). The duct passage 31 branches off to the drain valve 34 at an upstream place of the open-close valve 33. The outlet of the drain valve 34 is open via a drain duct 34*a* over the toilet-stool main body B1 (see FIG. 2 and FIG. 3): Herein, FIG. 2 and FIG. 3 show only the drain valve 34 and the drain duct 34*a* as typical members.

Figure 5:
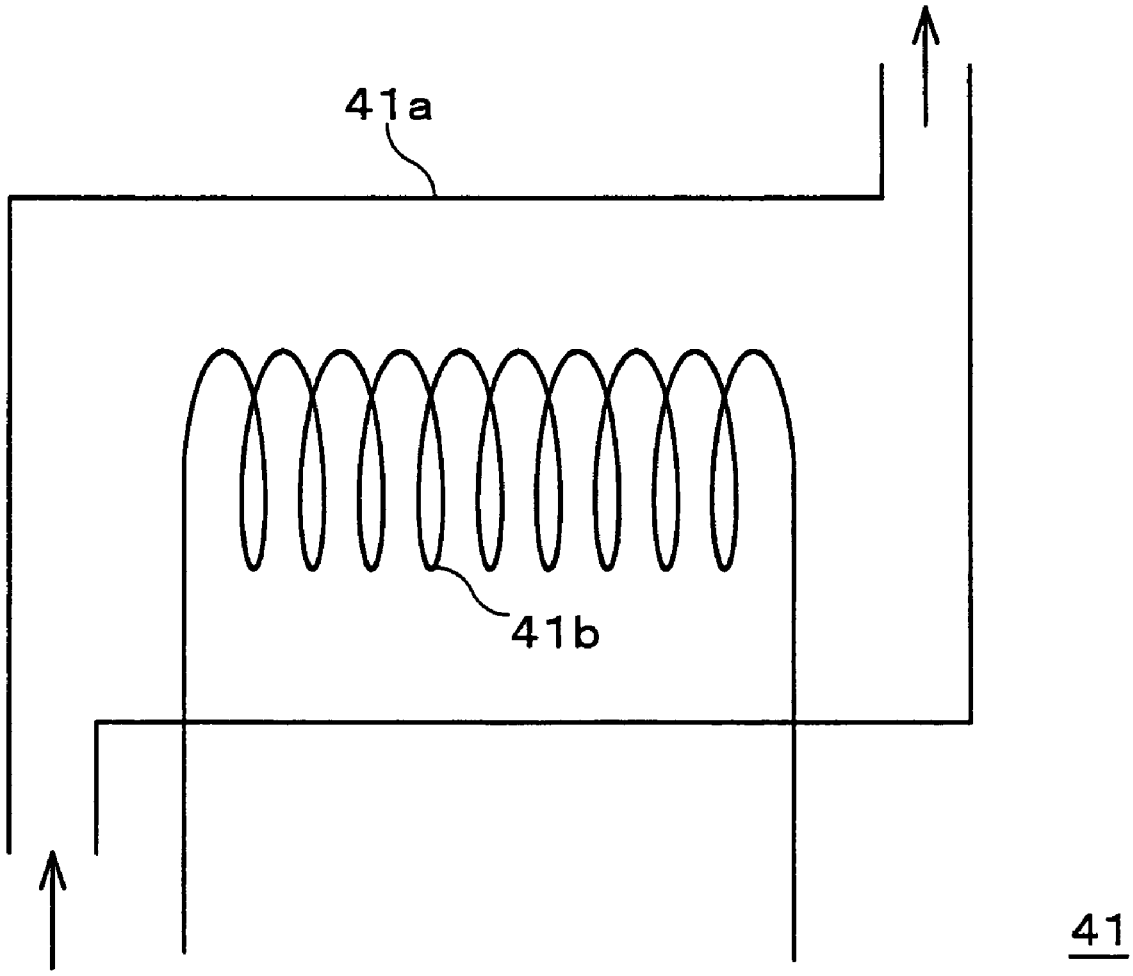
FIG. 5 is a schematic illustration showing a typical configuration of a major of a heater unit.

The mixing valve 35 is configured by combining control valves 35*a*, 35*b* on each side of cold water and hot water, respectively (see FIG. 4). The inlet of the control valve 35*a* on the cold-water side is connected to an outside water source C, while the inlet of the control valve 35*b* on the hot-water side is connected to a forked steam of the water source C, via a heater unit 41 attached to the outside of the case body 11. Herein, the heater unit 41 is configured, for example, by housing a sheathed heater 41*b* in a case-shaped heat-exchanger unit 41*a* (see FIG. 5), so that it works as an electric heater of the instantaneous water heater-type which heats up cold water flowing inside the heat-exchanger unit 41*a* to a suitable temperature. Herein, power switching of the sheathed heater 41*b* is properly controlled, for example, based on water temperatures on the outlet side of the heat-exchanger unit 41*a*.

Figure 6:
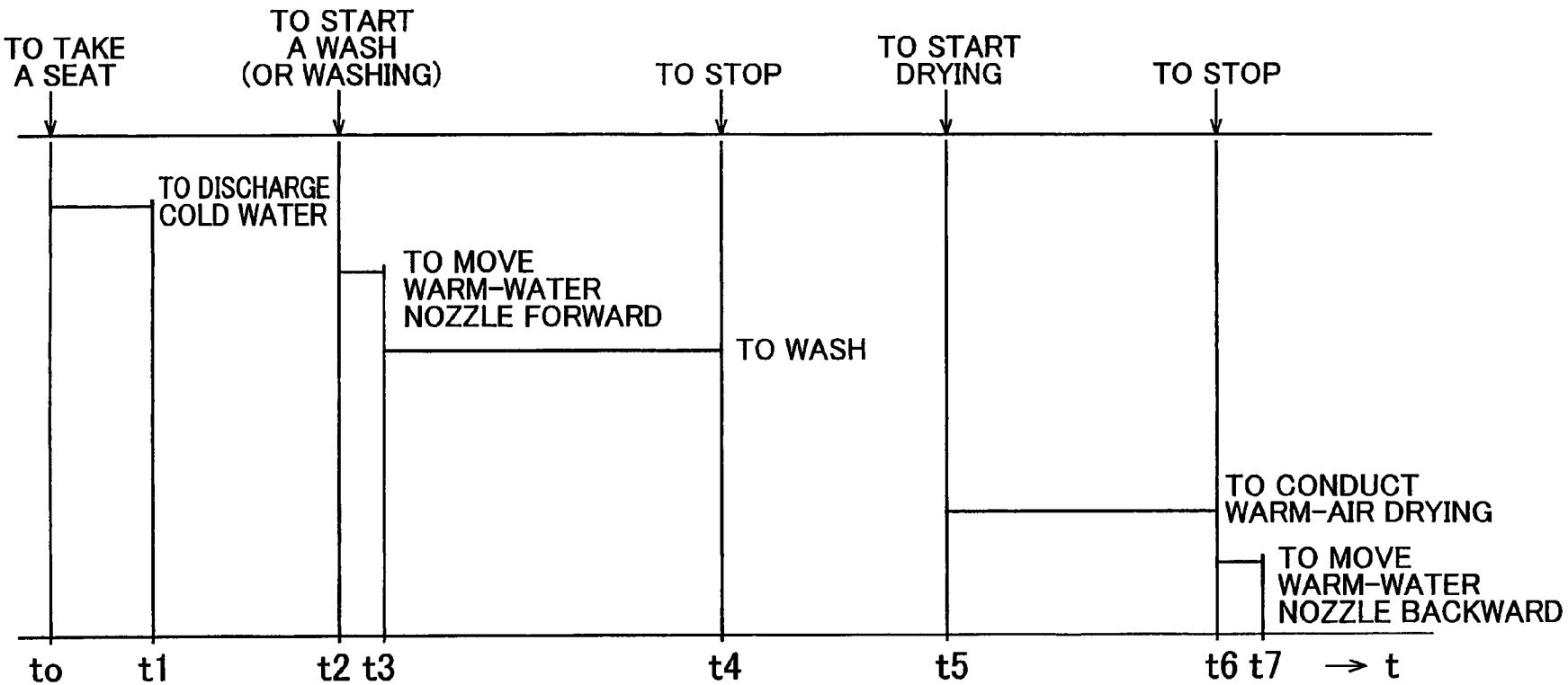
FIG. 6 is a graphical representation showing an operation of the body washing unit.

The body washing unit for a toilet stool, for example, works as shown in FIG. 6. In the body washing unit before use (at Time $t<t_0$ in FIG. 6), the warm-water nozzle 21 and the warm-air nozzle 22 is kept back at a waiting position inside the case body 11. The control valves 35*a*, 35*b* of the mixing valve 35, the open-close valve 33 and the drain valve 34 are all kept fully closed. And the heater unit 41 is not at work. When a user sits on the toilet seat B2 (at Time $t=t_0$ in FIG. 6, hereinafter simply referred to as ($t=t_0$)), a sensor (not shown) works to operate the heater unit 41 and open the control valves 35*a*, 35*b* of the mixing valve 35 to proper widths. Then, the drain valve 34 opens, discharging the cold water inside the duct passage 31 for the warm-water nozzle 21 into the toilet-stool main body B1 ($t=t_0$ to $t_1$). The mixing valve 35, via the control valves 35*a*, 35*b*, mixes cold water from the water source C and hot water from the heater unit 41 into warm water having a suitable temperature. Herein, the control valves 35*a*, 35*b* open automatically to predetermined widths so that warm water with a suitable temperature can be jetted out of the warm-water nozzle 21 with a proper water-current force. The cold water inside the duct passage 31 on the upstream side of the open-close valve 33 is all discharged and replaced with warm water from the mixing valve 35. Then the drain valve 34 is closed to start a waiting time ($t \geqq t_1$).

When the user operates a switch (not shown) to give the command to start a wash after evacuation ($t=t_2$), the motor 23*e* works to advance the warm-water nozzle 21 and the warm-air nozzle 22 to a usage position ($t=t_2$ to $t_3$). Then, the open-close valve 33 opens ($t=t_3$) and the warm water jetted out-of the warm-water nozzle 21 can wash the user's anal part ($t=t_3$ to $t_4$). Next, when the user operates an switch (not shown) to give the command to stop ($t=t_4$), the open-close valve 33 closes to complete the washing operation.

Next, when the user operates a switch (not shown) to give the command to start a drying operation ($t=t_5$), the warm-air heater 22*b* works so that the user can dry the anal part after the wash, using a blast of warm air from the warm-air nozzle 22 ($t=t_5$ to $t_6$). When the user gives the command to stop ($t=t_6$), the warm-air heater 22*b* stops and then the warm-water nozzle 21 and the warm-air nozzle 22 are moved back to the initial waiting position by means of the motor 23*e* ($t=t_6$ to $t_7$), allowing such a series of operations to be completed.

OTHER EMBODIMENTS

Figure 7:
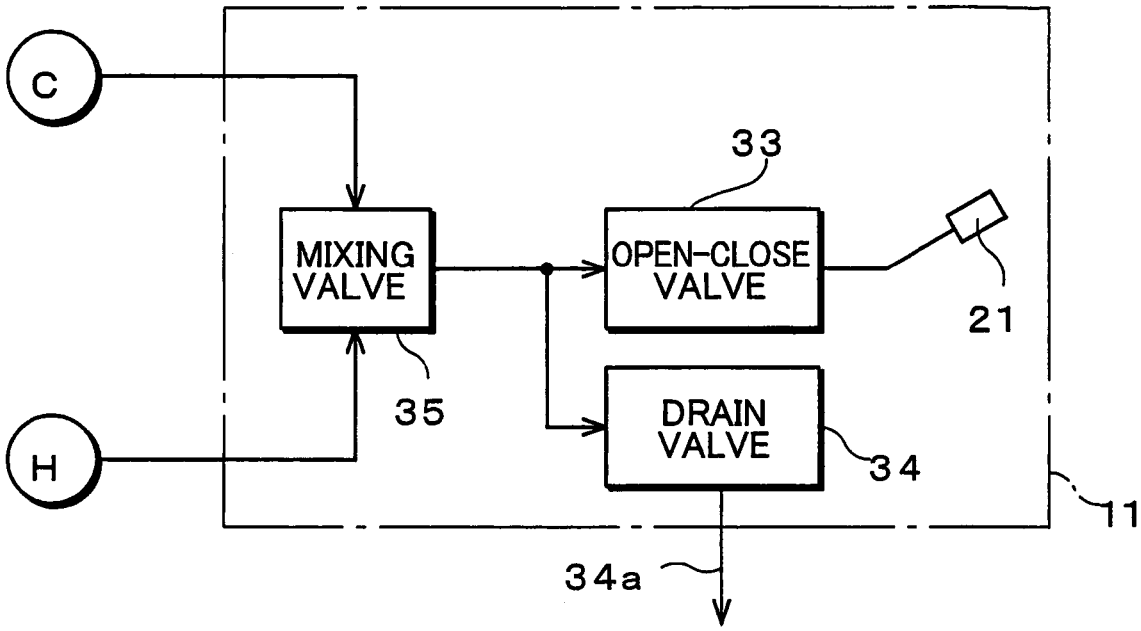
FIG. 7 is a water-flow diagram of a body washing unit for a toilet stool according to another embodiment, equivalent to FIG. 4.

At a location where a hot-water source H supplying warm water or hot water can be used, the heater unit 41 is not needed, and instead, the inlet on the hot-water side of the mixing valve 35 may be directly connected to the hot-water source H (see FIG. 7). In FIG. 4 and FIG. 7, the open-close valve 33 and the drain valve 34 may also be replaced with a single three-way selector valve which opens on either side of the warm-water nozzle 21 or the drain duct 34*a*, or closes on both sides.

Figure 8:
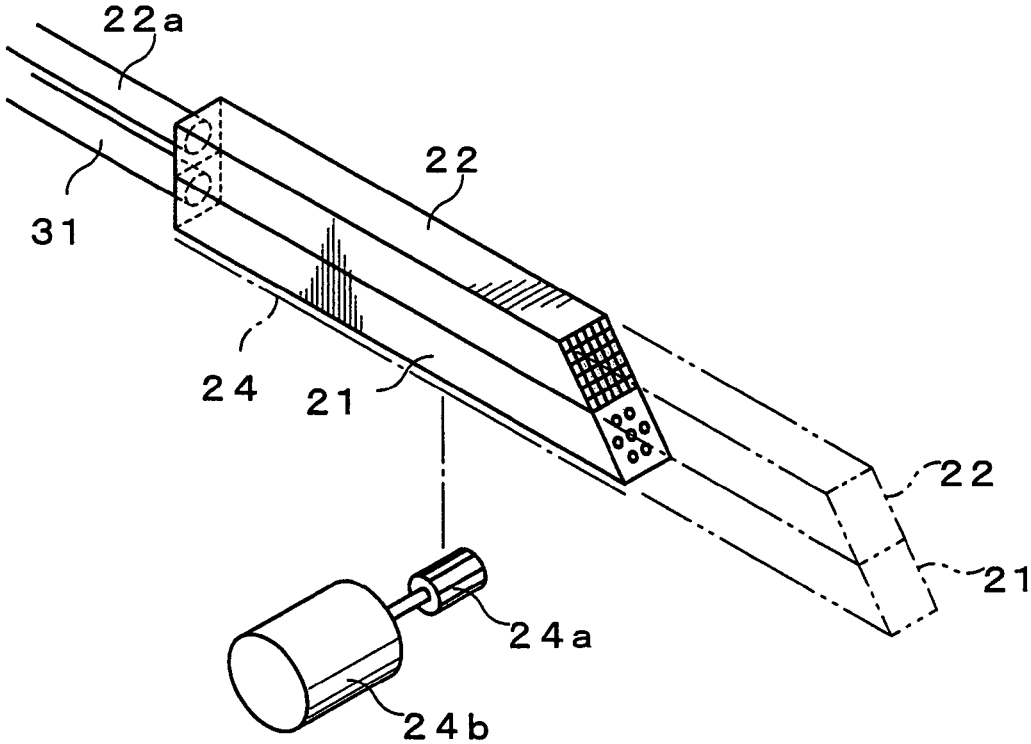
FIG. 8 is a perspective exploded view (1) showing a major part of a body washing unit for a toilet stool according to another embodiment.

The timing belt 23 used for the warm-water nozzle 21 and the warm-air nozzle 22 may also be replaced with: a rack 24 which unites the warm-water nozzle 21 and the warm-air nozzle 22; and a pinion 24*a* revolved by a motor 24*b*. According to this configuration, the warm-water nozzle 21 and the warm-air nozzle 22 are driven straight between a waiting position (see the solid line of FIG. 8) and a usage position (see the two-dotted chain line of FIG. 8). Herein, the tip part of the duct passage 31 connected to the warm-water nozzle 21 is formed out of a flexible hose, enabling the warm-water nozzle 21 to make motions.

Furthermore, the motors 23*e*, 24*b* used for electrically driving the warm-water nozzle 21 and the warm-air nozzle 22 may also be replaced, for example, with a hand-powered driving system for rotating the timing pulley 23*b* and the pinion 24*a* by means of a manual handle on the outside. Furthermore, the warm-water nozzle 21 and the warm-air nozzle 22 may also be separately driven to a waiting position and a usage position. For example, only the warm-water nozzle 21 may be driven to a waiting position and a usage position, while the warm-air nozzle 22 may be disposed and fixed inside the case body 11. This is because there is no need to control the blowing direction of warm air from the warm-air nozzle 22 with a fair degree of precision, as long as the warm air can dry an anal part. Furthermore, the warm-water nozzle 21 may also be driven to a waiting position and a usage position, by expanding and contracting its tip part in a telescopic way.

Figure 9:
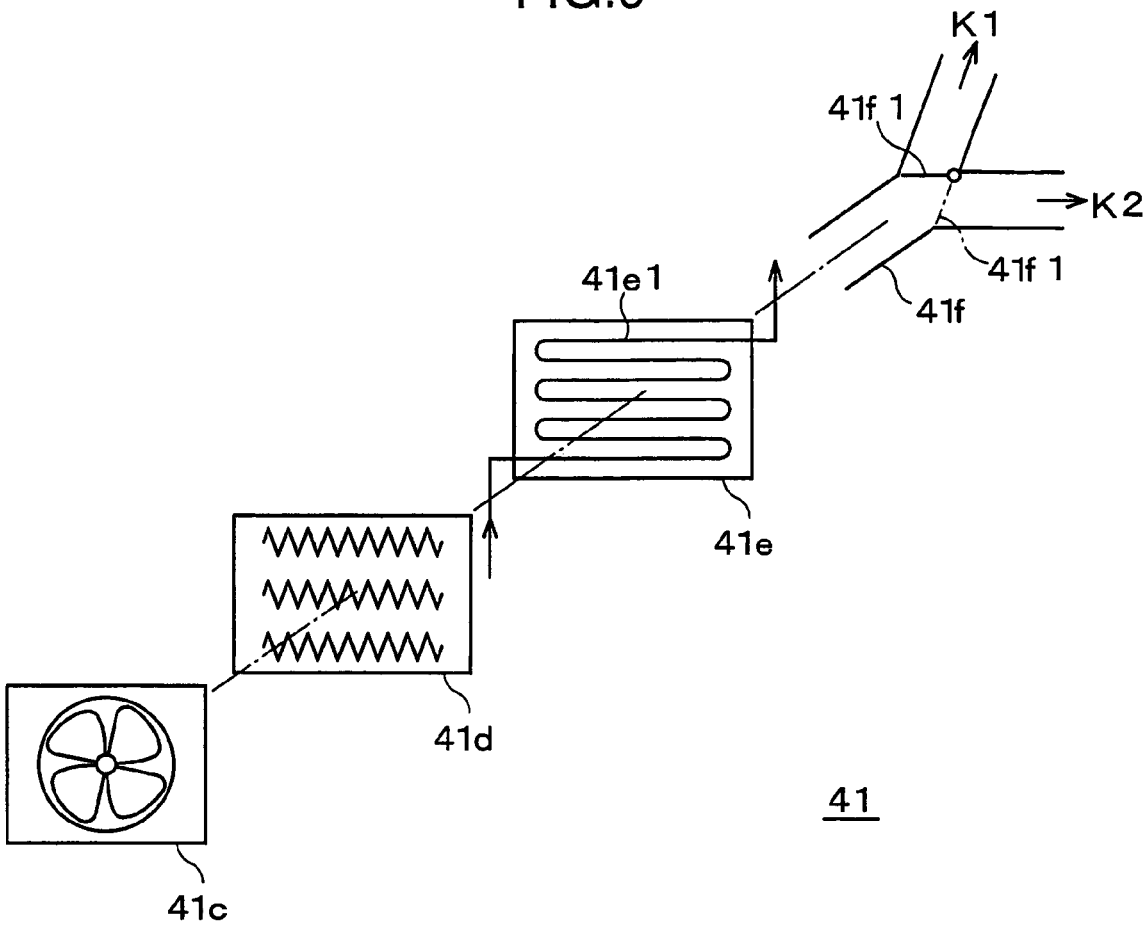
FIG. 9 is a perspective exploded view (2) showing a major part of a body washing unit for a toilet stool according to another embodiment.

The heater unit 41 can be configured by integrating a fan unit 41*c*, an electric heater 41*d* and a heat-exchanger unit 41*e* in the front-and-rear direction. A current of air blown by the fan unit 41*c* passes through the electric heater 41*d* and becomes hot. When passing through the heat-exchanger unit 41*e*, the hot air indirectly heats up water flowing through a finny coiled pipe $\mathbf{41}e_1$ to make the water hot so that it can be supplied to the mixing valve 35. Herein, hot air from the heat-exchanger unit 41*e* can be emitted outdoors, or used for indoor heating, by means of a louver $\mathbf{41}f_1$ attached inside a forking duct 41*f* (see the solid line and the two-dotted chain line of FIG. 9). In other words, one of the outlets of the forking duct 41*f* is open on the outside of a toilet booth housing a toilet stool (in the $K_2$ direction of FIG. 9). Herein, it is enough, for example, just to switch the louver $\mathbf{41}f_1$ manually according to the season.

In the above explanation, the spacer frame 12 on the front-surface side of the case body 11 can be omitted, for example, by additionally attaching a suitable spacer block onto the lower-surface side of the toilet seat B2. Herein, a toilet seat and a toilet-seat cover (not shown) which have already been hinged and connected to the case body 11 can also be used, so that no already-installed toilet seat and toilet-seat cover would have to be reused.

According to the first-described embodiment, cold water inside the duct passage 31 is discharged by opening the drain valve 34. However, the cold water inside the duct passage 31 from the mixing valve 35 to the open-close valve 33 may also be discharged by the process of: opening both the open-close valve 33 and the drain valve 34 before opening the mixing valve 35 to discharge the cold water inside the duct passage 31 from the open-close valve 33 to the warm-water nozzle 21; thereafter, closing the open-close valve 33; and opening the mixing valve 35. Preferably, the duct passage 31 from the mixing valve 35 to the warm-water nozzle 21, and the warm-water nozzle 21 itself, should each have a shape and an inclination suitable for cold water inside them to be discharged through the drain valve 34 as completely as possible. Instead of an electrically-operated valve, the mixing valve 35, the open-close valve 33 and the drain valve 34, may also be a hand-powered valve which a user sitting on the toilet seat B2 can operate manually on the outside of the case body 11.

ADVANTAGES OF THE INVENTION

Figure 10:
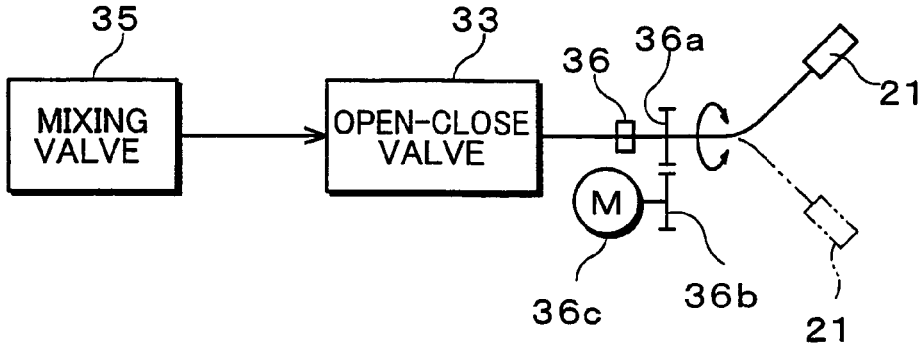
FIG. 10 is a schematic illustration showing the configuration of a major part of a body washing unit for a toilet stool according to another embodiment.

In FIG. 4 and FIG. 7, you can omit the drain valve 34 and the drain duct 34*a* by placing the warm-water nozzle 21 at a usage position and allowing it to switch from upward to downward (FIG. 10). A rotary joint 36 is attached to the base part of the warm-water nozzle 21. The bending duct passage from the rotary joint 36 to the warm-water nozzle 21 can be turned in forward and reverse directions (the arrow directions of FIG. 10) by a motor 36*c* connected thereto via gears 36*a*, 36*b*. The warm-water nozzle 21 is turned downward at a usage position (see the two-dotted chain line of FIG. 10) and the mixing valve 35 and the open-close valve 33 are opened. Thereby, the cold water inside the duct passage leading to the warm-water nozzle 21 can be discharged into the toilet-stool main body B1. Thereafter, if turned upward (see the solid line of FIG. 10), it can emit a jet of warm water to wash an anal part for its regular use. In FIG. 10, the warm-water nozzle 21 may also be turned, either together with the warm-air nozzle 22 or alone separately from the warm-air nozzle 22.

As described above, in the body washing unit for a toilet stool according to the present invention, a warm-water nozzle is incorporated into a case body, and cold water in a duct passage for the warm-water nozzle is discharged before the warm-water nozzle is used. This allows the user to feel comfortable When using the body washing unit, without any heater tank. Furthermore, the present invention simplifies the entire configuration of the body washing unit and enables an already-installed toilet seat and toilet-seat cover to be reused. As a result, the body washing unit can be added to a toilet stool that has already been installed, with ease and within reason.

Although the present invention has been fully described by way of example with reference to the accompanying drawings, it is to be understood that various changes and modifications will be apparent to those skilled in the art.

Therefore, unless otherwise such changes and modifications depart from the scope of the present invention hereinafter defined, they should be construed as being included therein.

What is claimed is:

1. A body washing unit for a toilet stool, comprising:

a case body disposed on the upper surface of a toilet-stool main body, a toilet seat and a toilet-seat cover being connectable to the case body so as to hinge;

a spacer frame supporting the toilet seat over the toilet-stool main body and being attached to a front surface of the case body;

a warm-water nozzle incorporated into the case body;

a duct passage for supplying warm water to the warm-water nozzle; and a drain valve connected to the duct passage, wherein the drain valve is operative for discharging cold water from the duct passage before the warm-water nozzle is used.

2. The body washing unit for a toilet stool according to claim 1, wherein the warm-water nozzle is driven between a waiting position inside the case body and a usage position on the side of the front surface of the case body.

3. The body washing unit for a toilet stool according to claim 2, wherein:

a mixing valve is incorporated into the case body; and the mixing valve mixes water from the outside and hot water and supplies warm water to the warm-water nozzle.

4. The body washing unit for a toilet stool according to claim 3, wherein:

a heater unit is attached to the outside of the case body; and the heater unit heats water from the outside and supplies the heated water to an inlet on the hot-water side of the mixing valve.

5. The body washing unit for a toilet stool according to claim 1, wherein:

a mixing valve is incorporated into the case body; and the mixing valve mixes water from the outside and hot water and supplies warm water to the warm-water nozzle.

6. The body washing unit for a toilet stool according to claim 5, wherein:

a heater unit is attached to the outside of the case body; and the heater unit heats water from the outside and supplies the heated water to an inlet on the hot-water side of the mixing valve.

7. A body washing unit for a toilet stool, comprising:

a case body disposed on the upper surface of a toilet-stool main body;

a toilet seat and a toilet-seat cover being connectable to the case body so as to hinge;

a spacer frame supported to a front surface of the case body and supporting the toilet seat over the toilet-stool main body; and a warm-water nozzle incorporated into the case body, wherein cold water in a duct passage for the warm water nozzle is discharged before the warm-water nozzle is used.

8. The body washing unit for a toilet stool according to claim 7, wherein the warm-water nozzle is driven between a waiting position inside the case body and a usage position on the side of the front surface of the case body.

9. The body washing unit for a toilet stool according to claim 7, wherein:

a mixing valve is incorporated into the case body; and the mixing valve mixes water from the outside and hot water and supplies warm water to the warm-water nozzle.

10. The body washing unit for a toilet stool according to claim 7, wherein:

a heater unit is attached to the outside of the case body; and the heater unit heats water from the outside and supplies the heated water to an inlet on the hot-water side of the mixing valve.

* * * * *